United States Patent [19]

Rattray

[11] 4,240,476

[45] Dec. 23, 1980

[54] HYDRAULIC LOG SPLITTING ATTACHMENT FOR A TRACTOR

[76] Inventor: Clarence G. Rattray, Rte. 1, Box 48, Reardan, Wash. 99029

[21] Appl. No.: 969,392

[22] Filed: Dec. 14, 1978

[51] Int. Cl.[3] ..... B27L 7/00

[52] U.S. Cl. ..... 144/193 A; 144/193 R

[58] Field of Search ..... 144/193 R, 193 A, 193 K, 144/3 K

[56] References Cited

U.S. PATENT DOCUMENTS

| | | | |
|---|---|---|---|
| 3,280,864 | 10/1966 | Spanenberg | 144/193 A |
| 3,319,675 | 5/1967 | Bles | 144/193 A |
| 3,760,854 | 9/1973 | Worthington | 144/193 A |
| 3,780,779 | 12/1973 | Guy | 144/193 A |
| 3,938,567 | 2/1976 | Dircksen et al. | 144/193 A |
| 4,076,062 | 2/1978 | Kanik | 144/193 A |
| 4,103,724 | 8/1978 | Braid | 144/193 A |

FOREIGN PATENT DOCUMENTS

| | | | |
|---|---|---|---|
| 231752 | 7/1944 | Switzerland | 144/193 R |

*Primary Examiner*—W. Donald Bray

*Attorney, Agent, or Firm*—W. Britton Moore

[57] ABSTRACT

A log splitting attachment including an elongated V-shaped channel frame for accommodating and immovably supporting various sized logs thereon between a slidably adjustable splitting wedge and knife and an adjustable butt plate of a hydraulic cylinder. The frame is projectable from and is removably attached to the drawbar of a tractor with a hydraulic system and is so supported thereby in a position parallel to and resting on the ground, and the cylinder is removably connectable to the hydraulic system whereby actuation of an accessible control on the frame slidably actuates the cylinder piston and butt plate relative to a splitting wedge adjustably mounted thereon to effect splitting.

4 Claims, 5 Drawing Figures

HYDRAULIC LOG SPLITTING ATTACHMENT FOR A TRACTOR

BACKGROUND OF THE PRESENT INVENTION

This invention relates to a log splitting attachment for removable attachment to and support by the drawbar of a hydraulically equipped tractor.

While many forms of log splitters have heretofore been proposed for attachment to tractors, such as those represented by U.S. Pat. Nos. to Spanenberg 3,280,864, Bles 3,319,675, Worthington 3,760,854, and Guy 3,780,779, such devices have not been entirely satisfactory in that the controls therefor are usually mounted on the tractor so as not to be readily accessible to the operator, and the logs are not immovably supported on and retained by the supporting frame and are frequently dislodged therefrom during the splitting operation.

BRIEF SUMMARY OF THE INVENTION

The present invention relates to a log splitting attachment removably attachable to the drawbar of a tractor and including an elongated channel frame having inwardly and oppositely facing V-shaped side walls. The frame is projectable from the tractor with a hydraulic system and includes a hydraulic cylinder and butt plate slidably arranged on the frame and spaced from and coacting with a splitting wedge and knife adjustably mounted relative to the side frame walls whereby a log is supportable between the butt plate and wedge and forced against the latter for splitting.

Accordingly, it is the principal object of the present invention to provide a log splitting attachment including an elongated V-shaped channel frame for immovably and adjustably supporting variously sized logs thereon between a slidably adjustable splitting wedge and knife and an adjustable butt plate of a hydraulic cylinder, with the frame being attached to and supported by the drawbar of a hydraulically equipped tractor and the cylinder being connected to the hydraulic system.

Another object is the provision of an elongated V-shaped channel frame with an elongated opening between the side members thereof for the escape of bark and chips therethrough and wherein the channel securely and immovably supports and retains a log thereon during splitting.

Still another object is to provide a V-shaped channel frame which accommodates various lengths and diameters of hydraulic cylinders thereon.

A further object is the provision of a V-shaped channel frame having a slidably adjustable splitting wedge with a starting knife edge thereon.

A still further object is to provide a strong, light weight and easily handled log splitting attachment wiich is readily connected to the drawbar of a tractor and is provided with attaching means therebetween for supporting the attachment in position for splitting use and transportation.

Still a further object is the provision of a log splitting attachment embodying an elongated V-shaped channel frame having a low profile resting on the ground for supporting the wood being split practically at ground level adjacent and handy to the source of logs.

These and other objects and advantages will be apparent as the specification is considered with the accompanying drawings, wherein FIG. 1 is a perspective view of the V-shaped channel frame attachment with hydraulic cylinder arranged thereon and coupled to the drawbar at the rear end of a tractor with a hydraulic system;

DETAILED DESCRIPTION

Figure 1:
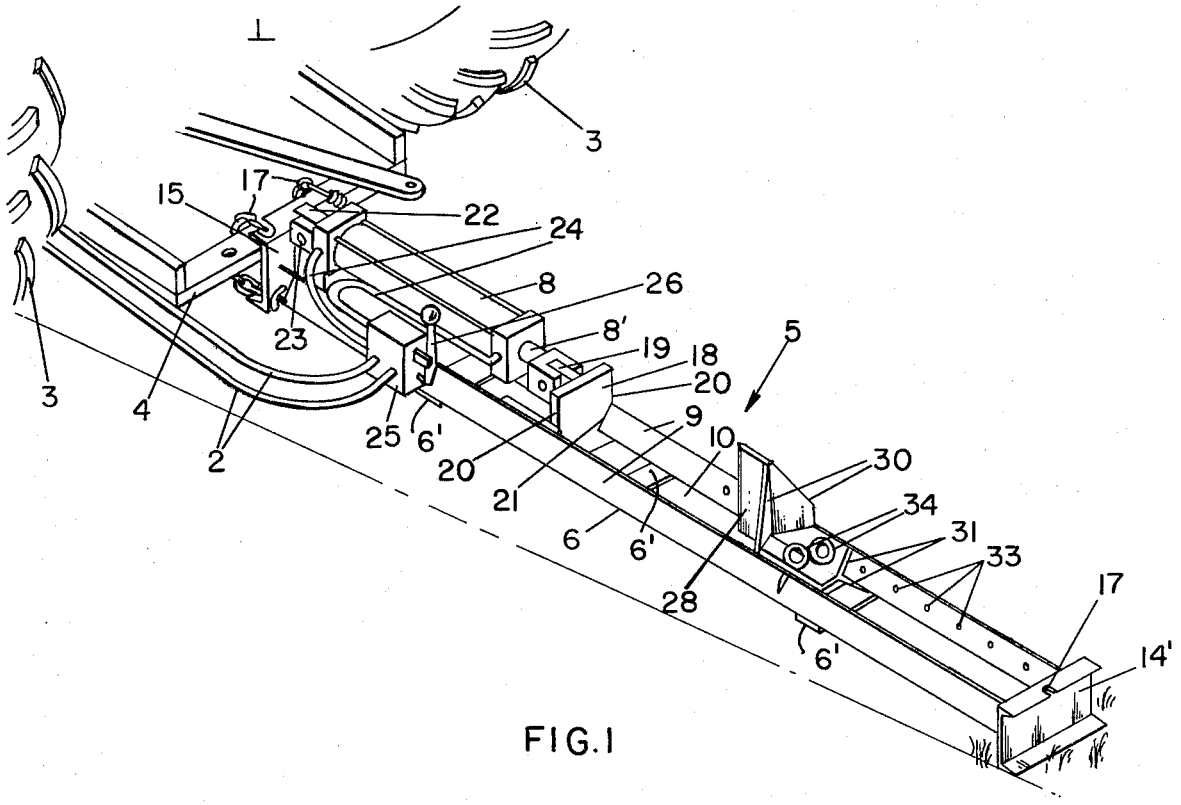
Figure 2:
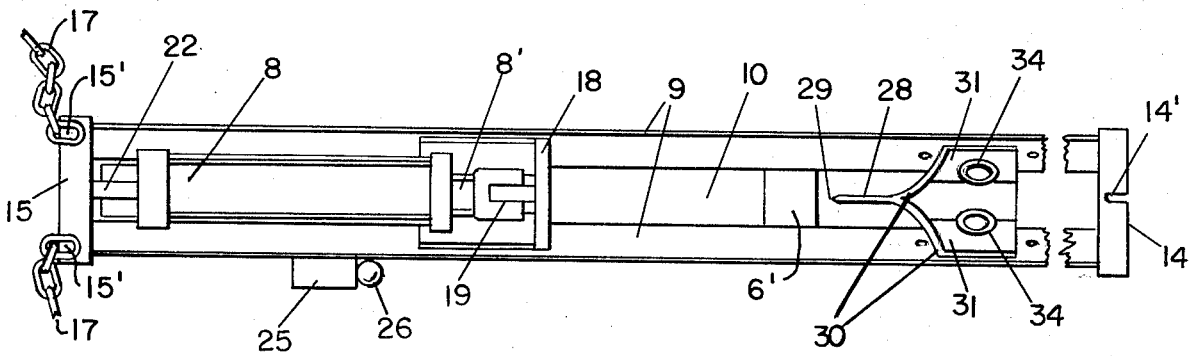
FIG. 2 is a top plan view of the attachment.
Figure 3:
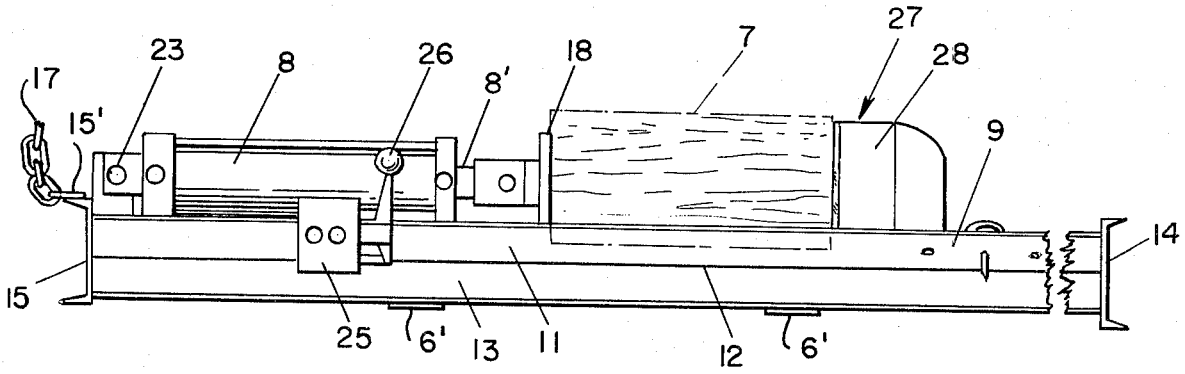
FIG. 3 is a side elevation.

Referring more particularly to the drawings, wherein similar reference characters designate like parts throughout the several views, numeral 1 generally designates the rear end of a conventional tractor equipped with the usual hydraulic pressure system including flexible lines 2. Extending from the rear end of the tractor between the enlarged rear wheels 3 thereof is a conventional metal drawbar or hitch 4 to which the log splitting attachment frame, about to be described, is attached.

The log splitting attachment 5 hereof includes an elongated generally V-shaped metal channel frame 6 for accommodating and immovably supporting a log 7 to be split and a hydraulic cylinder 8, presently to be described. Frame 6 is formed from two oppositely facing generally V-shaped channel members 9 parallel and spaced apart to provide an elongated slot or opening 10 therebetween. Thus, the uppermost plate 11 of each member extends inwardly and downwardly with the apices 12 facing each other and being spaced apart to form opening 10, and the lowermost plate 13 of each member projects downwardly and outwardly. The channel members 9 may be preformed in this generally V-shape, or the uppermost and lowermost plates 11-13 may be weldably connected at their apices. A log 6 may thus be seated on the angularly disposed upper plates 11 and will securely be retained on the channel frame. Arranged on and suitably attached by welding or the like to the outer ends of channel members 9 is a vertically disposed channel plate 14, and a similar channel plate 15 is provided at the opposing or inner ends thereof. In addition, a series of spaced flat brace plates 61 bridge and are suitably welded, or otherwise connected, to the undersides of the channel members 9 so that the latter constitute a strong and rigid channel frame.

Figure 4:
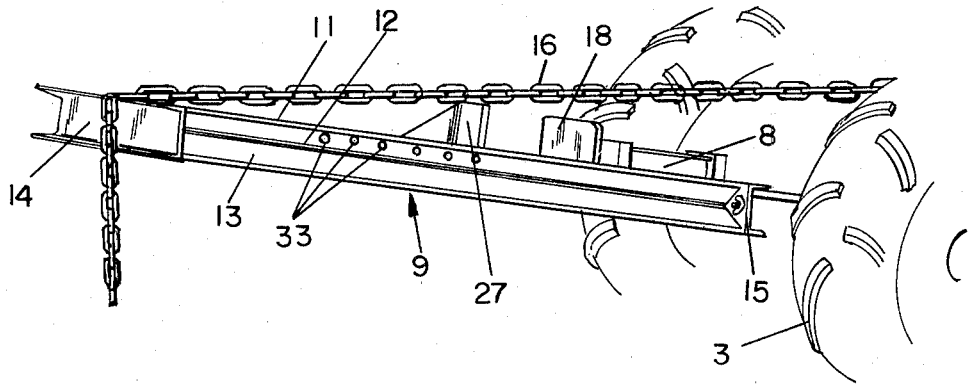
FIG. 4 is a side perspective view of the attachment connected to the tractor and elevated by a supporting chain in position for travel.

Channel plate 15 is formed with apertures 15' for receiving suitable connecting chains 17 therein which extend around tractor drawbar and serve to connect the channel frame attachment to the tractor, as shown in FIG. 1, so that the frame projects rearwardly and angularly therefrom with channel end plate 14 resting on and being supported by the ground. The frame may be raised and supported above the ground, as best shown in FIG. 4, by a chain 16, suitably connected to the rear of the tractor and extending rearwardly therefrom for insertion in a notch or the like 14' in the outer edge of end channel plate 14. When it is desired to elevate the frame for movement of the tractor, chain 16 is connected to channel plate 14, and the usual hydraulic control, not shown, on the tractor actuated to exert a pull on the chain to raise the outer end of the frame, in an obvious manner.

Hydraulic cylinder 8 is longitudinally disposed at the rear end of channel frame 6 and the forward end of piston rod 8' thereof is suitably swivably connected, as at 19, to a flat vertically disposed metal butt plate 18 which is formed with cut-outs 21 in the side edges 20 thereof to snugly and slidably interfit the angularly disposed upper and lower plates 11-13 of channel members 9 for longitudinal slidable movement thereover. The rear end of hydraulic cylinder 8 is suitably removably pivotally connected, as at 23, to an upright bar 22 extending from and suitably attached to the inner face of inner end channel plate 15. Hydraulic lines 24 extend from the opposing ends of cylinder 8 to a valve control box 25 suitably attached to one side of channel frame 6, adjacent the rear end thereof, and the control box 25 is, in turn, connected to the tractor hydraulic system lines 2 so that, when a suitable control lever 26 is actuated fluid is appropriately introduced into cylinder 8 to either extend or withdraw piston rod 8' and butt plate 18 relative to channel frame 6, in an obvious manner, and for a purpose hereinafter described.

Figure 5:
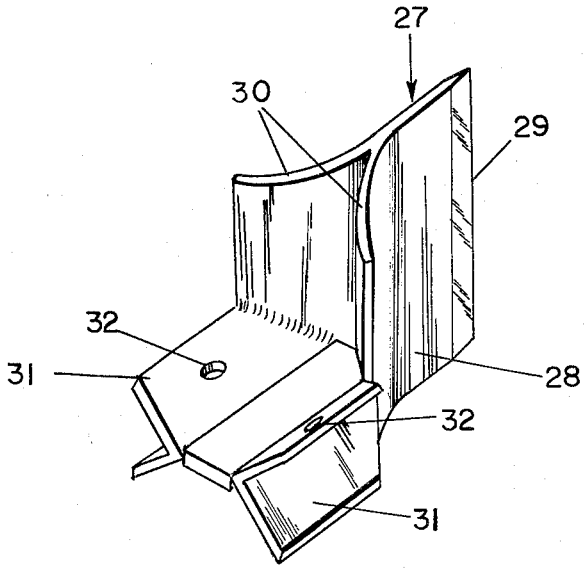
FIG. 5 is a perspective view of the splitting wedge and knife.

Spaced forwardly from butt plate 18 is a vertically disposed cutting knife and splitting wedge 27 embodying an upright flat rearwardly projecting plate 28 having a sharpened cutting and splitting edge 29. Wedge plate 28, as best shown in FIG. 5, is divergingly flared outwardly, as at 30, and is weldably or otherwise suitably connected to the rear ends of a pair of generally and oppositely V-shaped base channel members 31 interconnected by a bridging base plate 31. Channel members 30 slidably interfit V-shaped channel frame members 9 and are slidable thereover relative to butt plate 18. Apertures 32 in channel members 31 are alinable with a series of spaced apertures 33 in each of the angular disposed uppermost channel frame plates 11 and suitable pins may be inserted therethrough to anchor wedge plate 28 at a preselected position thereon. It will be noted that wedge plate 28 extends between the frame members 9 and opposite to but at right angles to butt plate 18.

A log 7 of a desired size and length is selected and positioned in the V-opening between the channel frame members 9 so as to extend longitudinally thereof. The control lever 25 is then actuated to introduce fluid into the rear end of hydraulic cylinder 8 through one of the lines 24 which moves the piston and piston rod forwardly therein and slidably forces the butt plate 18 into engagement with one end of the log. Continued movement of the piston rod and butt plate pushes the other end of the log against the knife and splitting edge 29 of wedge 27 to longitudinally split the log, in an obvious manner. In this connection, the sharp cutting edge of the wedge enables the latter to bite into the log, and the outwardly flared walls 29 on wedge plate spread apart the split log and facilitate splitting thereof. In addition, the V-shape of the channel frame members retain the log therein and prevent dislodgement thereof and the slotted opening 10 therein permits chips and bark to fall therethrough.

As the channel frame 6 is attached to the tractor drawbar and depends downwardly therefrom, it is disposed close to the ground and extends at a slight angle relative thereto, with its outer end channel plate 14 resting thereon and being supported thereby. Thus, the frame may be located adjacent to and convenient to a woodpile so that a log may be readily positioned on the frame with a minimum of lifting and handling.

When it is desired to move to another location, it is only necessary to attach the lifting chain 16 to the notched channel end plate 14 and elevate the frame above the ground level whereupon the frame may be moved with the tractor.

While a preferred embodiment of hydraulic log splitting attachment has been shown and described, it is to be understood that various changes and improvements may be made therein without departing from the scope and spirit of the appended claims.

What I claim is:

1. In a hydraulic log splitting attachment for a tractor equipped with a drawbar and a hydraulic pressure system comprising an elongated channel frame including spaced apart oppositely disposed generally V-shaped plates providing an elongated opening therebetween to accommodate said plates, embrace and retain a log to be split thereon and therebetween, butt plate means having generally V-shaped side edge cutouts interfitting said plates and slidably arranged thereon, hydraulic cylinder means on said frame with the piston thereof swivably connectable to said butt plate means, said frame having end plates on opposing ends, one end plate being pivotally connectable to said drawbar, and said cylinder being connectable to said pressure system, a cutting and splitting wedge plate means including a base portion slidably adjustable on said channel frame and spaced from said butt plate means, said wedge plate having a cutting plate upstanding from and extending at right angles relative to said base portion, said cutting plate being flat and flared outwardly at its rearward portion and having a sharpened cutting edge forwardly thereof, and said base portion projecting rearwardly of said wedge and formed with generally V-shaped base channel members interfitting said channel frame plates and slidably adjusting said wedge thereon, control valve means on said channel frame connectable to said pressure system whereby when a log is positioned between said V-shaped plates said wedge and butt plate means, and said cylinder actuated to force said butt plate means against one end of the log the other end thereof is pushed against said wedge to effect splitting thereof.

2. In a splitting attachment, according to claim 1, wherein said hydraulic cylinder means is swivably and removably connected at its opposing ends to said butt plate and one of said frame end plates, and said last mentioned end plate is pivotally connected to said tractor drawbar.

3. In a splitting attachment, according to claim 2, wherein said channel frame projects rearwardly and downwardly angularly from said tractor drawbar so as to extend at a low height above and adjacent to the ground, and the outer end thereof rests on and is supported by the ground, and chain means connected to said tractor and removably connectable to said outer end plate for elevating said frame for transportation.

4. In a splitting attachment, according to claim 1, wherein said channel frame V-shaped plates are apertured, and the base portion of said wedge plate is apertured, and pin means is insertable through said apertures when alined to adjustably anchor said wedge plate relative to the said frame.

* * * * *